US005570940A

United States Patent [19]

Maro

[11] Patent Number: 5,570,940

[45] **Date of Patent: *Nov. 5, 1996**

[54] DOOR SYSTEM FOR A DOORLESS STORING STRUCTURE

[75] Inventor: Nicholas Maro, Chicago, Ill.

[73] Assignee: Viking Metal Cabinet Co., Inc., Chicago, Ill.

[ * ] Notice: The term of this patent shall not extend beyond the expiration date of Pat. No. 5,464,281.

[21] Appl. No.: 471,830

[22] Filed: Jun. 7, 1995

Related U.S. Application Data

[63] Continuation-in-part of Ser. No. 20,572, Feb. 22, 1993, Pat. No. 5,464,281.

[51] Int. Cl.[6] ..... A47B 47/00; F06B 3/00

[52] U.S. Cl. ..... 312/257.1; 312/329; 49/366

[58] Field of Search ..... 312/109, 138.1, 312/326, 329, 257; 49/504, 366, 388

[56] References Cited

U.S. PATENT DOCUMENTS

| | | | |
|---|---|---|---|
| 1,916,189 | 7/1933 | Bales | 312/257.1 X |
| 2,591,172 | 4/1952 | Ludine | 312/329 X |
| 2,796,628 | 6/1957 | Van Meter | 16/230 |
| 3,166,367 | 1/1965 | Vincens | 312/329 |
| 3,186,782 | 6/1965 | Ullman | 312/329 X |
| 4,412,708 | 11/1983 | Palka | 312/329 |
| 4,836,626 | 6/1989 | Taylor et al. | 312/257 |
| 5,464,281 | 11/1995 | Maro | 312/257.1 |

FOREIGN PATENT DOCUMENTS

| | | | |
|---|---|---|---|
| 482892 | 1/1970 | Switzerland | 312/257.1 |
| 957812 | 5/1964 | United Kingdom | 312/257.1 |

*Primary Examiner*—Peter M. Cuomo
*Assistant Examiner*—David E. Allred
*Attorney, Agent, or Firm*—Dvorak and Traub

[57] ABSTRACT

A quick attach door system for enclosing a doorless shelved structure, such as a cabinet, wherein the shelves are supported by a number of apertured uprights which are used to accept the installation of a pair of vertically spaced door support members, each door support member being provided with apertured upright attachment members and with a door supporting structure, the door supporting members having portions extending outwardly of the upright members, a pair of door-halves being supported by the door support members, wherein the door-halves are coupled to the door support members by hinge devices that are retractable to permit installation and removability of the door-halves. The hinge devices can be secured to prevent retractability once the door-halves are shut and locked. Door striker plates serve as door stops when the door is in a closed position and magnets disposed within the door adjacent the door striker plates secure the doors in the closed position.

17 Claims, 3 Drawing Sheets

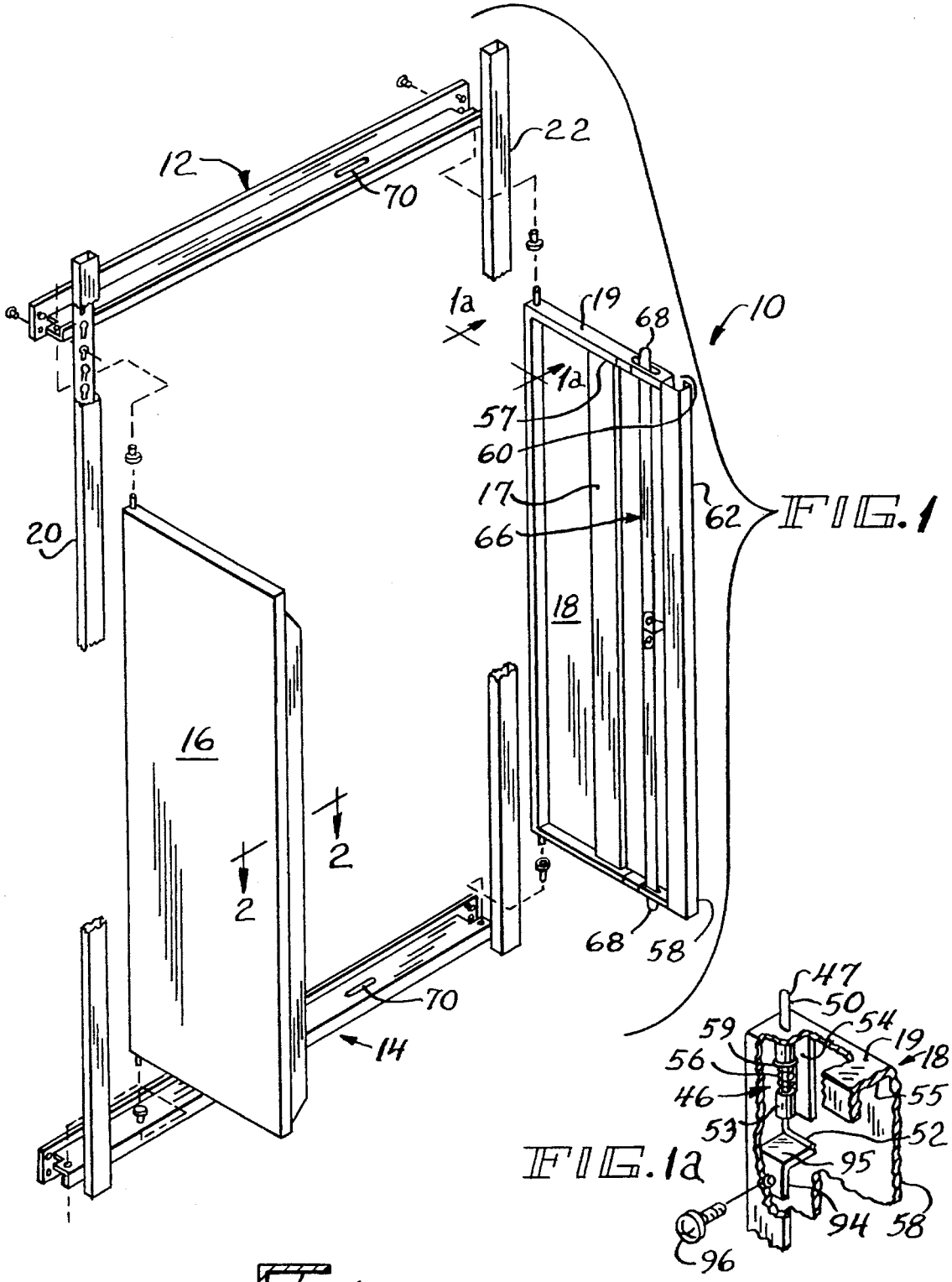
FIG. 1
FIG. 1a
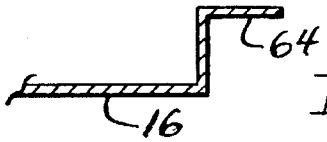
FIG. 2

DOOR SYSTEM FOR A DOORLESS STORING STRUCTURE

RELATED APPLICATIONS

The present application is a continuation in part application of U.S. application Ser. No. 08/020,572, filed 22 Feb. 1993 and entitled Quick Attach Door System For a Doorless Storing Structure, now U.S. Pat. No. 5,464,281.

BACKGROUND OF THE INVENTION

The present invention relates to a door system which can be installed on a storing structure such as a cabinet or other furniture provided with shelves for storing articles, the structure or cabinet having an open face, that is, without a door. The invention is particularly concerned with a quick attach door system for installation on an open face cabinet.

In the past, door systems installed on open face, doorless cabinets were provided with full perimeter flames having doors attached to vertical uprights with butt hinges and in some cases continuous piano type hinges. In these prior art systems, installation generally requires drilling and fastening with bolts to support the perimeter frame on the cabinet opening. Such prior art door systems require excessive time for installation compared to the present invention. The installation is time-consuming and is an economical factor leading to an extensive expense, especially where multiple installations are required. Manufacturing time and cost is extensively higher due to product complexities, packaging and shipping to the installation site.

The present invention relates to a door system readily attached to an existing storage shelving support structure, such as a cabinet having an open face. The invention can be utilized with different types of cabinets manufactured by well known manufacturers like Spacesaver, Aurora, Tennsco, as well as with other cabinets having similar shelf support structure within the interior of the cabinet. The above mentioned cabinets are generally provided with vertical apertured uprights some of which are fastened to the back of the cabinet and the other vertical uprights are attached to the front vertical sides of the cabinet opening. The apertures in the vertical uprights are adapted to receive shelving provided with lugs which are fitted into the apertures. This provision is also used in the present invention wherein an upper support member and a lower support member are provided with lugs which are fitted into the apertured uprights. Only in this case, the upper and lower support members are attachable to the front uprights adjacent the opening in the cabinet. The door used in the present invention comprises a pair of door halves, each door half being provided with a pair of retractable spring pin hinges, thus making an efficient and economical system to install.

Manufacturing, packaging and shipping to the site of installation are design benefits because the doors which are preassembled with a lock catch and retractable spring pin hinges are still individual or separate and can be compactly packed with individual upper and lower preassembled support members.

It is accordingly an object of the invention is to provide a door system which can be quickly attached to a doorless structure such as an open face cabinet, provided with vertically arranged shelves.

Another object of the invention is to provide a door system having door halves which can be readily installed and dismounted if necessary.

It is also an object of the invention is to provide a door system using a pair of door halves provided with quick release hinge members.

A further object of the invention is to provide a door supported by quick release spring pin hinges which can be placed in a latched, non-removable, manner.

SUMMARY OF THE INVENTION

A door system for equipping a doorless structure provided with vertically arranged shelves supported on vertical apertured uprights, such as in a storage cabinet, wherein a pair of vertically spaced support members are provided with vertical apertured upright attachment means and with a door supporting means, the door supporting means extending outwardly of the vertical apertured upright attachment means to support a pair of door halves which are retractably hinged to the door supporting means. Each upright attachment means have a pair of vertically extending faces provided with aperture engagement means which is provided with lugs. Alternatively, the aperture engagement means has tabs punched outwardly of the vertical faces. The faces also include holes for accepting screws adapted for fastening the upright attachment means with respect to the uprights. A swinging edge of each door half is provided with an extended flange to engage with a corresponding extended flange on the other door half, wherein one of the door halves is provided with a lock catch for engagement with the door supporting means. Each door half is supported by retractable hinge means in the form of a spring pin hinge positioned along a pivot swing line of the door-half, the spring pin hinge having a pin extending out of upper and lower edges of the door half, each pin being retractable into the interior of the door-half. In particular, each support member has a structure that has an elongated vertically extending face adapted to span across and to abut the vertical uprights, each end of each face having a lug. A horizontal flange extends outwardly from the face and terminates in a vertically extending flange to define a channel with the face. Each end of the horizontal flange, adjacent its respective lug, has a cut-out adapted to accommodate the presence of an upright.

A door system for equipping a doorless shelf structure having shelf-supporting apertured uprights, the structure being an open face cabinet, the system having a pair of vertically spaced upper and lower support members, each having a vertically extending face, and at least a pair of lug members extending out of the face intended for engagement with uprights in the cabinet, the face having a horizontal flange extending in the same direction as the lug members. The horizontal flange terminates in a vertically extending flange to define a channel with the face, the horizontal flange also having at each end a pivot hole, each end of the horizontal flange having a cut-out adjacent the respective pivot hole and respective lug member. A pair of door-halves, at their pivot axes, are provided with upper and lower spring pin hinges having pivot pins engageable with said pivot holes in the upper and lower support members. At least one pin on each door-half is retractable from its door-half engaging position. Each door-half has a swinging edge provided with a lapping portion to engage with an extending flange on the other door-half. One of the door-halves has a lock device with members protruding out of the door-half and engageable with the upper and lower support members. The engagement is achieved with slots in the support members receiving the protruding members from the lock device. The upper support member on its face, adjacent each lug, is provided with a hole for receiving a screw for fastening the upper support member to the upright and to prevent accidental dislodgement. As described hereinabove, the horizontal flanges terminate in vertically extending flanges for the purpose of rigidifying the horizontal flange along its longitudinal axis. If the gauge of the metal forming the upper and lower support members is substantially thick, it is not necessary to provide the vertically extending flange.

A door system for equipping a doorless shelved structure having shelf supporting apertured uprights, such structure being an open-face cabinet, a pair of vertically spaced upper and lower support members provided with vertically extending faces, at least a pair of lug members extending out of the faces and intended for engagement with the apertured uprights. Each of the faces has a horizontal flange extending in the same direction as the respective lug members, the horizontal flange having at each end a pivot hole and an adjoining cut-out adjacent respective pivot holes and respective lug members. The cut-outs are intended to provide clearance for the upright members. The upper and lower support members support a pair of door-halves, each door-half, at its pivot axis, being provided with upper and lower spring pin hinges which are engageable with the respective holes in the upper and lower support members.

These and other objects, features and advantages of the present invention will become apparent upon consideration of the following Detailed Description of the Invention with the accompanying drawings.

BRIEF DESCRIPTION OF THE DRAWINGS

The invention will now be described in conjunction with the following drawings, wherein:

FIG. 1 is a perspective view of a cabinet door opening provided with a pair of vertical apertured uprights adapted for receiving a pair of door-halves;

FIG. 1*a* is a partial cross-sectional view of an upper corner of a door provided with a spring pin hinge, the cross-section being taken along the lines 1*a*—1*a;*

FIG. 2 is a partial cross-sectional view of a door shown in FIG. 1, along the lines 2—2;

DETAILED DESCRIPTION OF THE INVENTION

Figure 4:
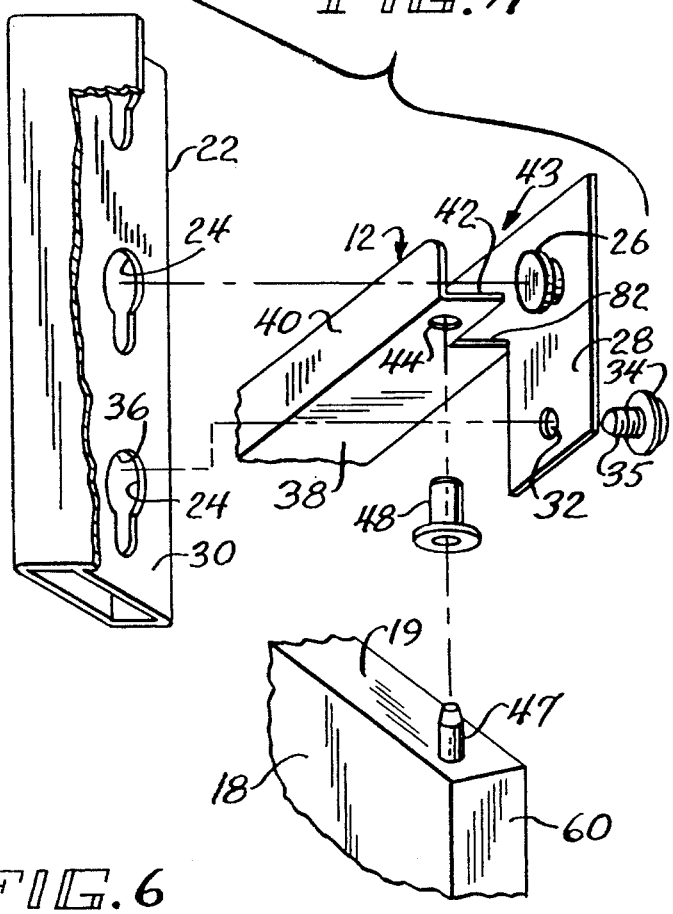
FIG. 4 is an enlarged exploded view showing the installation of an upper door support member on an apertured upright, and also showing the installation of the door-half on the upper door support member.

FIG. 1 shows a quick attach door system 10 with an upper vertically-shaped support member 12 and a lower vertically-shaped support member 14 for supporting a left door member 16 and a right door member 18, wherein the upper support member 12 is supported by left and right apertured uprights 20 and 22 and, similarly, the lower support member 14 is supported by the left and right apertured uprights 20 and 22. The door members 16 and 18 define a pair of door halves, wherein each door may include one or more diagonal or vertical door stiffening members 17 to add rigidity and strength to the door structure. The attachment of the upper and the lower support members to the uprights is best illustrated in FIG. 4, wherein the upright 22 is provided with a series of apertures 24 which are adapted to receive a capped lug 26 extending from a vertical face 28 of the upper support member 12, the vertical face 28 adapted to abut a vertical face 30 of the upright 22. The vertical face 28 of the upper support member 12 has an opening 32 for receiving a screw 34 which, after the installation is completed, a threaded surface 35 of the screw 34 will engage threadedly with an inner surface 36 of the aperture 24, this engagement preventing accidental upsetting of the upper support member 12 in case the doors are jarred upwardly. The vertical face 28 and the lug 26 define upright attachment means. Extending from the vertical face 28 of the upper support member 12 is a horizontal flange 38 which in turn terminates in a vertically bent flange 40 to define with respect to the vertical face 28 a channel 43. Adjacent each end 42 of the upper support member 12 is an opening 44 for receiving a pin 47 of a spring pin hinge 46, which pin can be provided, if desired, with a bushing spacer 48 preferably made from plastic material. The pin 47 and the spring pin hinge define a retractable hinge means.

Figure 3:
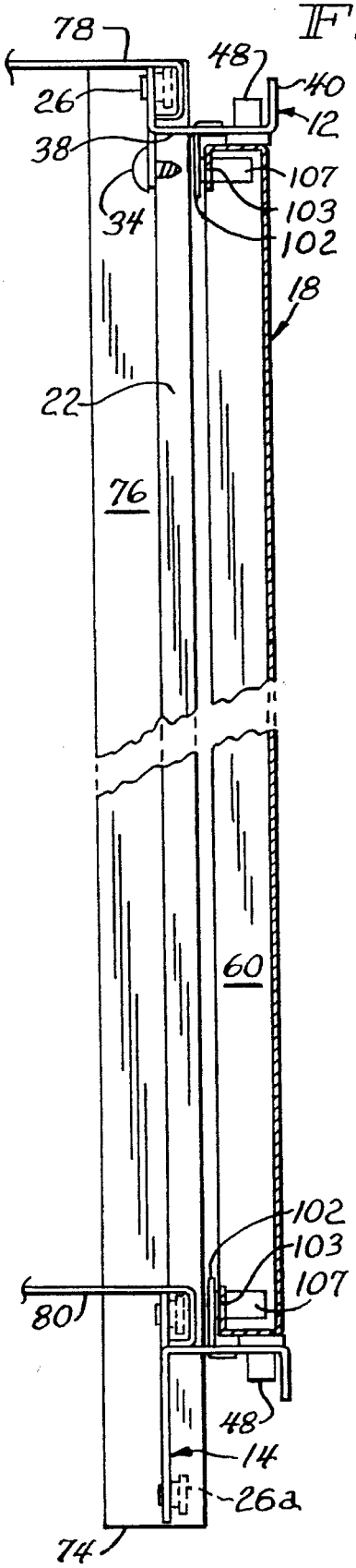
FIG. 3 is a shortened cross-sectional view along one edge of a cabinet provided with hardware supporting a door-half on the cabinet.

The details of the spring pin hinge 46 can be better seen, as to its mounting, on the door 18 in FIG. 1*a*. The pin 47 has a long leg 50 provided with a finger hold 52, the leg 50 being vertically and movably supported along its plate 54. The pin 47 is biased upwardly or outwardly of the door by a spring 56. The leg 50 is provided with a ring 59 abuttable against an undersurface of a sleeve through which the leg extends to limit the protrusion of the pin 47 through an upper edge 19 of the door. To prevent unauthorized depressing of the pin 47 into the interior of the door when the doors are locked, a lock tab 94 is provided to immobilize the depression of the pin 47. The door 18, as shown in FIG. 1, has a hollow box construction having a panel face 58 having a flanged border 57 around the perimeter of the door, except for an edge 60, which is provided with an extended flange 62 adapted to overlap an extended flange 64 of the door 16. The door 18 is provided with a lock catch 66 having lock tabs 68 which are adapted to engage with slots 70 in the upper and lower support members 12 and 14, respectively. The structure of the lower support member 14 is comparatively similar to that of the upper support member 12, but the lower support member 14 has a longer vertical face 28*a* as shown in FIG. 3, wherein a bottom of the vertical face 28*a* will nearly touch a bottom 74 of a cabinet. FIG. 3 also shows installation of the door system 10 in a cabinet 76 which, for simplicity, shows only a top shelf 78 and a bottom shelf 80.

The upper support member 12 and the lower support member 14 and equivalents constitute the vertically-shaped support members, the vertically extending faces 28 and 28*a* and equivalents constitute the upright attachment means, the capped lugs 26 and the tabs 86 and equivalents constitute the aperture engagement means, the left door member 16 and the right door member 18 and equivalents comprise a pair of door-halves, the end 42 of the upper support member 12 and the end 42*a* of the lower support member 14 and equivalents constitute the door supporting means, and the spring pin hinge 46 and equivalents constitutes the hinge means.

Figure 5:
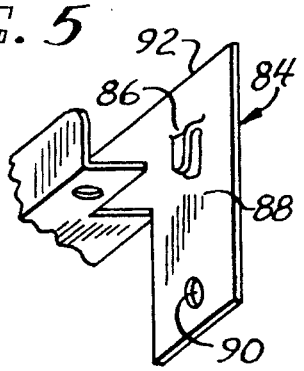
FIG. 5 is an enlarged partial view of an end of the upper door support member provided with a tab instead of a lug for engagement with the upright.
Figure 6:
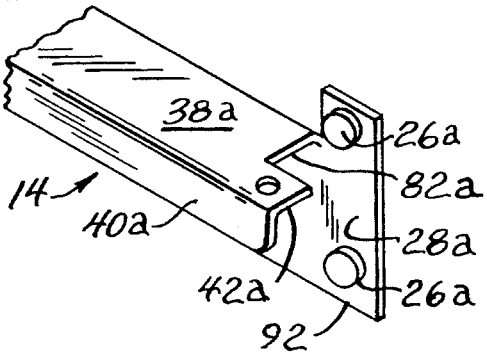
FIG. 6 is an enlarged partial end view of an alternative embodiment of a lower door support member.

FIG. 5 is an alternative embodiment of the upper support member 12 having an upper support member 84 with a vertical face 88 provided with a tab 86 instead of a capped lug 26 for attaching the upper support member 84 to the upright. The face 88 is provided with a hole 90 for receiving a screw 34 for securing the upper support member permanently to the uprights. The lower support member 14 can also be modified in accordance with the embodiment in FIG. 5 except that the tab 86 punched out of the face 88 would be directed so that the tip of the tab extends toward the lower edge 92, and in one embodiment the lower support member includes two tabs for engaging corresponding apertures 24 of the uprights 20 and 22, respectively. FIG. 6 is an alternative embodiment of the lower support member 14 which includes, on the vertically extending face 28*a* of each end, two capped lugs 26*a* for engagement with corresponding apertures 24 of the uprights 20 and 22, respectively. Use of two tabs 86 or lugs 26 on the lower support member 14 ensures that the lower support member squarely engages the uprights 20 and 22, and ensures secure engagement of the support member 14 to the uprights. From the face 28*a*, there is a horizontally extending flange 38*a*, the free end of which terminates in a vertically extending flange 40*a*. The flange 38*a* has ends 42*a* with a cut-out 82*a* adapted to abut the apertured upright 22. The installed position of the lower support member 14 can be viewed better in FIG. 3. The capped lug or lugs 26 and the tab 86 constitute aperture engagement means.

Figure 7:
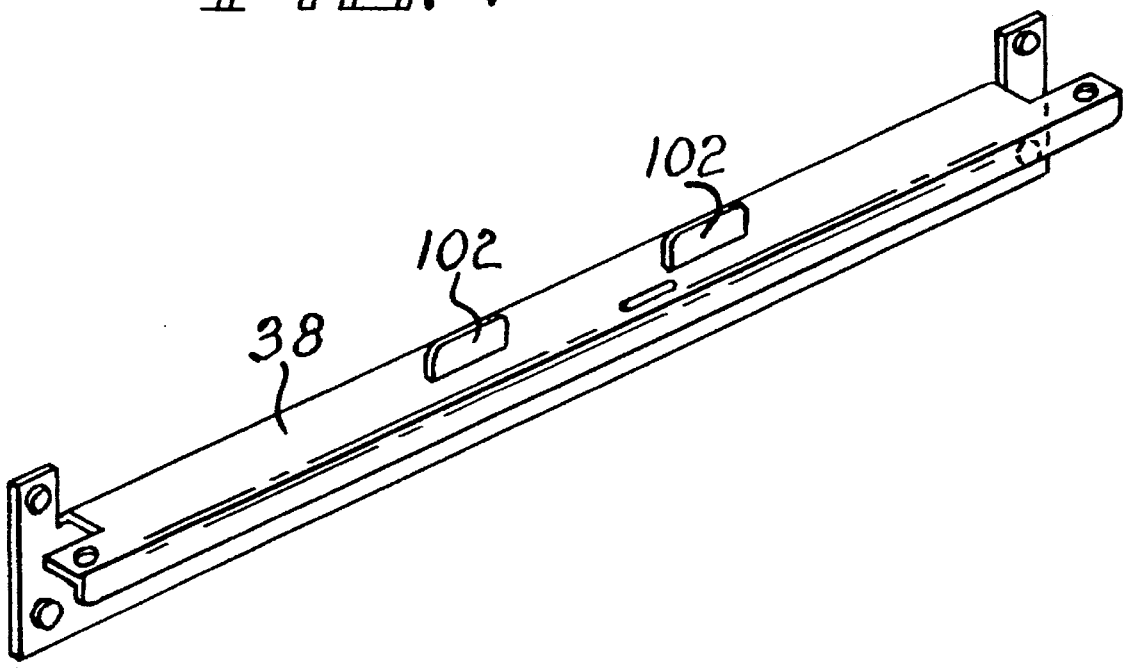
FIG. 7 shows striker plates on the lower support member which serve as stops for abutting an inner surface of the doors in the closed position.

FIGS. 1 and 7 shows striker plates 102 on the lower support member 14 which serve as stops for abutting an inner surface 103 of the doors 16 and 18 in the closed position. The upper support member 12 may also include striker plates 102, although a single centrally located striker plate on only one of the support members is suitable for stopping both doors in most applications. In the embodiment of FIG. 1, the plates 102 comprise angled members fastened by spot welding or other means to the support members. In another embodiment, the plates 102 are punched out of the horizontal flange 38. The striker plates 102 may include a pad for example a felt or plastic pad 105 fastened to an outer door engaging surface of the plate for abutting the surface 103 of the door to reduce noise when closing the door. In one embodiment, the plates 102 are formed of a magnetically attractive material and each door includes a magnetized material 107 disposed adjacent the inner surface 103 of the door. The magnetized material is attracted to the magnetically attractive plate 102 to securely maintain the door in the closed position with and without engagement of the tabs 68 of the catch latch 66, wherein the door is retained against the striker plate by the magnetized material when the door is in the closed position.

To install the door system into the doorless cabinet 76, the shelves, for example, top shelf 78 and the bottom shelf 80 are removed. Then, upper support member 12 is engaged with apertured upright 22 by inserting the capped lug 26 into one of the apertures 24 and then secured to the upper support member to prevent accidental dislocation by inserting the screw 34 to engage with a lower aperture 24 in the upright 22. Similarly, the other end of the upper support member 12 is engaged with an aperture in the other upright member 20, as best viewed in FIG. 1. A similar procedure is followed for installing the lower support member 14 with respect to the left and right uprights 20 and 22, respectively. However, there is no need for using a screw 34 to attach the lower support member to the uprights. After the upper and lower support members 12 and 14 have been secured to the uprights 20 and 22, the shelves are replaced. The vertical face 28 of the vertical support member 12 and the capped lug 26 comprise the upright attachment means. The vertical flange 40 and the horizontal flange 38 of the upper support member 12 comprise the door supporting means. Each end of the horizontal flange 38 is provided with a cut-out 82 to accommodate the installation of the upper support member 12 abutted against the upright 22.

The foregoing description will enable those skilled in the art to make and use the preferred embodiments of the present invention. Those skilled in the art will appreciate and understand that there exists variations, modifications and equivalents to the exemplary embodiments disclosed herein. The present invention therefore is to be limited only by the scope of the appended claims.

What is claimed is:

1. A door system for equipping a doorless shelved structure having shelf-supporting apertured uprights, said structure being an open-face cabinet, said system comprising:

an upper support member having a vertically extending face with opposing end portions, at least one engagement member extending out of each end portion of the face towards the apertured uprights and engageable with the apertured uprights, said face having a horizontal flange extending in the same direction as the engagement members, said horizontal flange terminating in a vertically extending flange to define a channel with said face, said horizontal flange having near each end a pivot hole, each end of the horizontal flange having a cut-out adjacent the respective pivot hole and respective engagement member;

a lower support member vertically spaced from the upper support member, the lower support member having a vertically extending face with opposing end portions, at least two engagement members extending out of each end portion of the face towards the apertured uprights and engageable with the apertured uprights, said face having a horizontal flange extending in the same direction as the engagement members, said horizontal flange terminating in a vertically extending flange to define a channel with said face, said horizontal flange having near each end a pivot hole, each end of the horizontal flange having a cut-out adjacent the respective pivot hole and respective engagement members; and a pair of door-halves, each door-half at its pivot axis being provided with upper and lower pin hinges engageable with respective pivot holes in the upper and lower support members.

2. A system according to claim 1, wherein at least one spring pin hinge on each door-half is provided with a pin which is retractable into the door-half interior.

3. A system according to claim 1, wherein each door-half has a swinging edge provided with a lapping portion to engage with an extended flange on the other door-half, and one of said door-halves has a lock device having lock members engageable with the upper and lower support members.

4. A system according to claim 3, said upper and lower support members on their respective horizontal flanges having slots to receive said lock members.

5. A system according to claim 1, wherein the upper support member on its face, adjacent each engagement member, is provided with a hole for receiving a lock screw.

6. A system according to claim 1, wherein each of said engagement members comprises a capped lug.

7. A system according to claim 1, wherein each of said engagement members comprises a tab punched out of the face.

8. A system according to claim 1, further comprising a door striker plate disposed on a central portion of at least one of the support members, wherein the doors are engageable with the door striker plate in a closed position.

9. A system according to claim 8, wherein the door striker plate is comprised of a magnetically attractive material, and each door includes a magnetized material disposed on a portion of the door adjacent the door striker plate when the door is in the closed position, wherein the door is retained against the striker plate by the magnetized material when the door is in the closed position.

10. A door system for equipping a doorless shelved structure having shelf supporting apertured uprights, said structure being an open-face cabinet, said system comprising:

an upper support member having a vertically extending face with opposing end portions, at least one engagement member extending out of each end portion of the face towards the apertured uprights and engageable with the apertured uprights, said face having a horizontal flange extending in the same direction as the engagement members, said horizontal flange having near each end a pivot hole, each end of the horizontal flange having a cut-out adjacent the respective pivot hole and respective engagement member;

a lower support member vertically spaced from the upper support member, the lower support member having a vertically extending face with opposing end portions, at least two engagement members extending out of each end portion of the face towards the apertured uprights and engageable with the apertured uprights, said face having a horizontal flange extending in the same direction as the engagement members, said horizontal flange having near each end a pivot hole, each end of the horizontal flange having a cut-out adjacent the respective pivot hole and respective engagement members; and a pair of door-halves, each door-half, at its pivot axis, being provided with upper and lower pin hinges engageable with the respective holes in the upper and lower support members.

11. A door system according to claim 10, wherein each of said horizontal flanges terminates in a vertically extending flange which defines a channel with respect to the face for rigidizing said horizontal flange along its longitudinal axis.

12. A door system according to claim 11, wherein at least one spring pin hinge on each door-half is provided with a pin which is retractable from the upper support member.

13. A door system according to claim 10, wherein each door-half has a swinging edge provided with a lapping portion to engage with an extended flange on the other door-half, and one of said door-halves has a lock device having lock members engageable with the upper and lower support members.

14. A door system according to claim 13, wherein said upper and lower support members on their respective horizontal flanges have slots to receive said lock members.

15. A door system according to claim 8, wherein the upper support member on its face, adjacent each engagement member, is provided with a hole for receiving a lock screw.

16. A system according to claim 10, further comprising a door striker plate disposed on a central portion of at least one of the support members, wherein the doors are engageable with the door striker plate in a closed position.

17. A system according to claim 16, wherein the door striker plate is comprised of a magnetically attractive material, and each door includes a magnetized material disposed on a portion of the door adjacent the door striker plate when the door is in the closed position, wherein the door is retained against the striker plate by the magnetized material when the door is in the closed position.

* * * * *